United States Patent [19]

Downing et al.

[11] 4,063,932

[45] Dec. 20, 1977

[54] METHOD FOR ADMIXING SOLIDS IN MOLTEN METAL

[75] Inventors: James H. Downing, Clarence; Robert H. Kaiser, Youngstown; William L. Murphy, Lockport, all of N.Y.; William R. Vaughn, Russellville, Ala.

[73] Assignee: Union Carbide Corporation, New York, N.Y.

[21] Appl. No.: 693,557

[22] Filed: June 7, 1976

Related U.S. Application Data

[63] Continuation of Ser. No. 489,164, July 17, 1974, abandoned.

[51] Int. Cl.[2] ..... C21C 7/00; C22B 9/02

[52] U.S. Cl. ..... 75/61; 75/50; 75/93 R

[58] Field of Search ..... 75/50, 61, 93, 77

[56] References Cited

U.S. PATENT DOCUMENTS

| | | | |
|---|---|---|---|
| 3,871,872 | 3/1975 | Downing | 75/61 |
| 3,915,694 | 10/1975 | Ando | 75/61 |

*Primary Examiner*—Peter D. Rosenberg
*Attorney, Agent, or Firm*—Frederick J. McCarthy, Jr.

[57] ABSTRACT

A vessel in which molten metal is stirred is provided with an interior configuration which prevents the formation of a vortex in the stirred metal thereby reducing the surface area of the metal.

3 Claims, 2 Drawing Figures

METHOD FOR ADMIXING SOLIDS IN MOLTEN METAL

Figure 1:
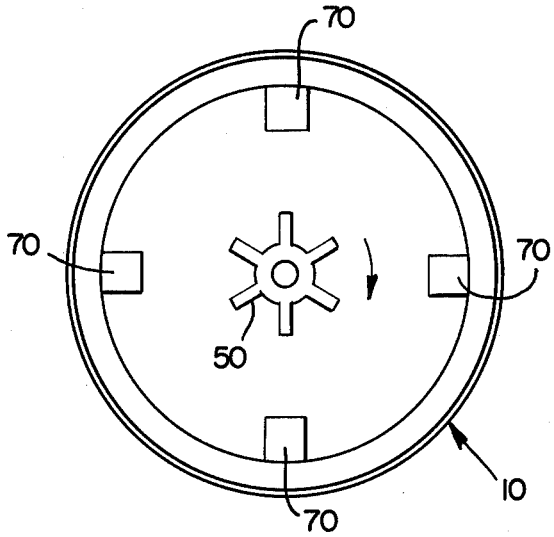

This application is a continuation of our prior U.S. application Ser. No. 489,164 filed July 17, 1974, now abandoned.

The present invention is directed to the stirring of molten metal to promote metallurgical reactions therein. More particularly the present invention is directed to the stirring of molten metal in a manner such that vortexing is avoided in the molten metal whereby the exposed surface area of the molten metal is minimized and consequently the oxidation of oxidizable constituents of the moten metal is minimized.

It is a well known industrial practice to add materials to a molten metal bath and to stir the molten metal in order to promote metallurgical reactions in the metal bath. For example, calcium carbide is added to iron base melts for the purpose of desulphurization and additions of other solid materials are made to other molten baths as is well known to the art.

An effective way to promote metallurgical reactions in a metal bath is to stir the molten metal in a vessel, e.g., a ladle, to impart a rotational motion to the molten metal. At high speed stirring, a substantial vortex is developed in the molten metal which increases the surface area of the molten metal exposed to the air and causes undesirable increased oxidation of the oxidizable constituents of the molten metal.

It is accordingly an object of the present invention to reduce vortexing in stirred molten metal to minimize the oxidation of oxidizable constituents in the molten metal.

Figure 2:
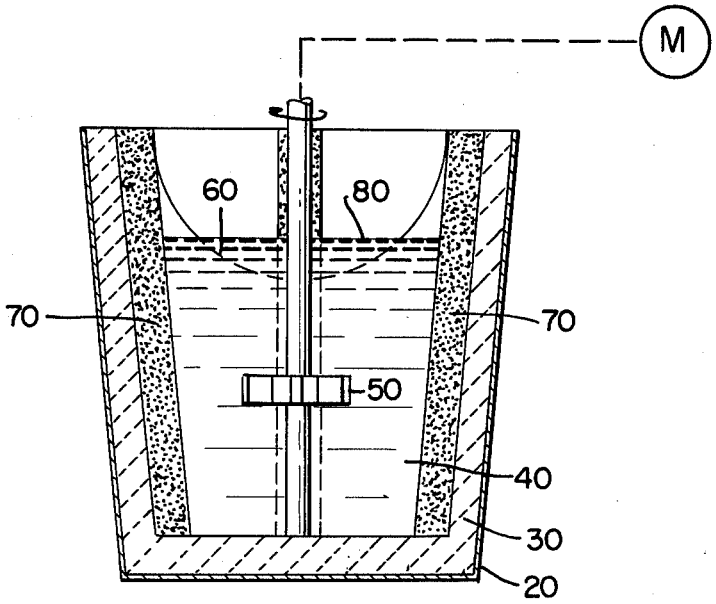

Other objects will be apparent from the following description and claims taken in conjunction with the drawing in which:

FIGS. 1 and 2 illustrate a plan and elevational view respectively of an apparatus in accordance with the present invention.

In accordance with the present invention, molten metal is stirred in a vessel having a substantially circular cross-section and baffle members are arranged adjacent the inner sidewalls of the ladle in a configuration which prevents any substantial vortexing at the upper surface of the molten metal.

The present invention will be more fully understood with reference to FIGS. 1 and 2 of the drawing wherein a ladle 10 having a shell 20, suitably formed of cast steel, and a refractory lining 30, is shown containing molten metal 40. A stirring member, shown as motor-driven impeller 50, suitably made of graphite, causes rotational motion in molten metal 40, in addition to turbulent mixing, to promote metallurgical reactions in the molten metal, e.g., desulphurization when calcium carbide is added to molten cast iron. At high speeds of impeller 50, the surface of molten metal 40 would assume a position such as indicated at 60 in FIG. 2. Under such circumstances, the surface of molten metal 40 which is exposed to the air is substantially increased and oxidizable constituents in the molten metal 40 are thus subject to increased oxidation on account of the increased surface area and substantial loss of these constituents can occur and seriously impede the desired metallurgical reactions in the melt. In the practice of the present invention, this undesirable situation is avoided by providing baffle members 70 adjacent the inner sidewalls of the ladle 10. The baffle members 70 are suitably formed of carbon, graphite, or refractory and can be cast in place when the ladle lining 30 is formed. Baffle members 70 are arranged symetrically about the circumference of the circular cross-section of the ladle 10 and extend at least from the surface 80 of molten metal 40 to at least 70% of the depth of molten metal 40. The baffle members 70 should extend radially inward a distance of at least 1/10 of the inner diameter of the ladle 10. Under such conditions, at speeds of impeller 50 which would ordinarily cause a substantial surface vortex, the surface of the molten metal 40 remains substantially horizontal and there is no substantial increase in exposed molten metal surface. Consequently, oxidation of oxidizable constituents in molten 40 is minimized. The present invention is applicable to all situations where additions are made to provide metallurgical reactions in molten metal, including the dissolution of solids in molten metal.

In the practice of the present invention at least two baffle members are required and the best operation is obtained with three or more baffle members, preferably four as shown in the drawing. The baffle members are preferred to have the minimum thickness consistent with the required structural strength.

What is claimed is:

1. A method for stirring molten metal having its upper surface exposed to air and having at least one constituent which is oxidizable upon exposure to air at the temperature of the molten metal, said method comprising imparting rotational motion to said molten metal in a vessel of substantially circular cross-section by means of a stirring member immersed in said molten metal substantially at the vertical axis of said vessel, and providing at least two baffle members arranged symetrically about the vertical axis of said vessel, each said baffle member being adjacent the inner sidewall of said vessel and extending radially inward therefrom, and each said baffle member extending from at least the surface of said molten metal to at least 70% of the depth of said molten metal, said baffle members preventing the development of a surface vortex in said molten metal and maintaining the surface of said molten metal substantially horizontal to minimize the exposure to air of said at least one oxidizable constituent.

2. A method in accordance with claim 1 wherein said molten metal is iron.

3. A method in accordance with claim 1 wherein said baffle members extend inward from said sidewall about 1/10 of the diameter of said vessel.

* * * * *